US007142170B2

(12) United States Patent
Saunders et al.

(10) Patent No.: US 7,142,170 B2
(45) Date of Patent: Nov. 28, 2006

(54) MULTIFILAR HELIX ANTENNAS

(75) Inventors: Simon Reza Saunders, West Sussex (GB); Daniel Kwan Chong Chew, Surrey (GB)

(73) Assignee: University of Surrey, Surrey (GB)

( * ) Notice: Subject to any disclaimer, the term of this patent is extended or adjusted under 35 U.S.C. 154(b) by 0 days.

(21) Appl. No.: 10/505,052

(22) PCT Filed: Feb. 18, 2003

(86) PCT No.: PCT/GB03/00760

§ 371 (c)(1),
(2), (4) Date: Mar. 21, 2005

(87) PCT Pub. No.: WO03/071631

PCT Pub. Date: Aug. 28, 2003

(65) Prior Publication Data

US 2005/0162334 A1 Jul. 28, 2005

(30) Foreign Application Priority Data

Feb. 20, 2002 (GB) ..... 0204014.5

(51) Int. Cl.
*H01Q 1/36* (2006.01)

(52) U.S. Cl. ..... 343/895

(58) Field of Classification Search ..... 343/895, 343/702; 333/202

See application file for complete search history.

(56) References Cited

U.S. PATENT DOCUMENTS 4,910,481 A * 3/1990 Sasaki et al. ..... 333/134
5,635,945 A 6/1997 McConnell et al.
5,854,608 A * 12/1998 Leisten ..... 343/895
5,986,616 A 11/1999 Edvardsson
6,150,994 A 11/2000 Winter et al.
6,160,523 A 12/2000 Ho
6,181,295 B1 * 1/2001 Sharaiha et al. ..... 343/895
6,184,845 B1 2/2001 Leisten et al.
6,232,929 B1 5/2001 Ermutlu et al.
6,400,339 B1 * 6/2002 Edvardsson et al. ..... 343/895
6,421,028 B1 7/2002 Ohgren et al.
6,885,855 B1 * 4/2005 Vuoppola ..... 455/306

FOREIGN PATENT DOCUMENTS

EP 1 150 382 10/2001
GB 2 292 638 2/1996

OTHER PUBLICATIONS

Bates, R.N.; "Design of microstrip spur-line band-stop filters", *Microwaves, Optics and Acoustics*, vol. 1, No. 6, pp. 209-214 (Nov. 1977 UK).

Hammad, H.F. et al.; "Dual band aperture coupled antenna using spur line", *Electronics Letters*, vol. 33, No. 25, pp. 2088-2090, (Dec. 1977 UK).

Sanchez-Hernandez, D. et al.; "Analysis and Design of a Dual Band Circularly Polarized Microstrip Patch Antenna", *IEEE Transactions on Antennas and Propagation*, vol. 43, No. 2, pp. 201-205, Feb. 1995.

* cited by examiner

*Primary Examiner*—Tan Ho
(74) *Attorney, Agent, or Firm*—Leydig, Voit & Mayer, Ltd.

(57) ABSTRACT

A multifilar helix antenna includes helical antenna filaments, each filament having a square waveform pattern along its length, resulting in reduced axial length. A multifilar helix antenna according to the invention includes helical antenna filaments, each filament incorporating a microstrip spur-line band stop filter enabling multi-band operation.

15 Claims, 8 Drawing Sheets

MULTIFILAR HELIX ANTENNAS

FIELD OF THE INVENTION

Figure 1A:
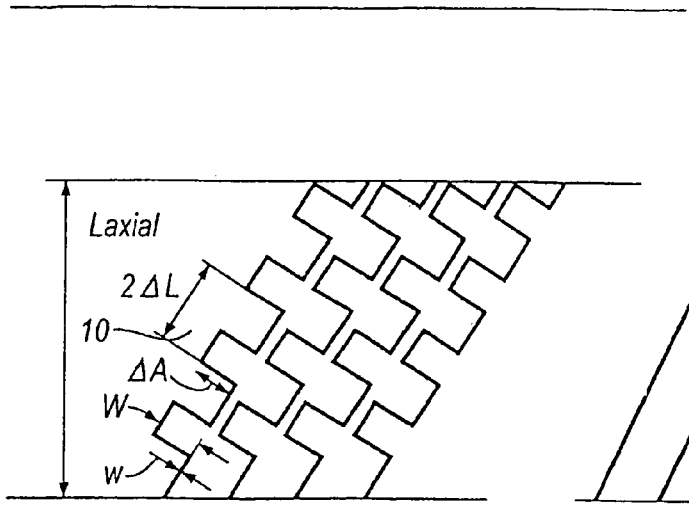

The invention relates to multifilar helix antennas, particularly, though not exclusively, quadrifilar helix antennas.

BACKGROUND OF THE INVENTION

The quadrifilar helix antenna (QHA) has been widely advocated for use, inter alia, in mobile satellite communications systems. Compared with crossed dipole and patch antennas, the QHA offers the advantages that it has a small, compact structure, is relatively insensitive to the effects of handling and of the ground and has a radiation pattern and a wide circularly polarised beam that can be readily shaped. The so-called printed QHA (PQHA) is particularly advantageous because of its light weight, low cost, high dimensional stability and ease of fabrication.

Although existing PQHA structures are already quite small, further size reduction is still required to satisfy the space limitations in handheld mobile communications terminals.

Various approaches have been adopted with a view to reducing the physical size of a QHA. One approach involves loading the QHA with a dielectric material such as Zirconium Titinate ceramic. Although this gives significant size reduction, the operating bandwidth of the antenna is very small, typically about 30 MHz which is unsatisfactory for many mobile communications applications.

A coupled-segment QHA has also been proposed. In this case the helical antenna filaments are separated into upper and lower segments which are interleaved in overlapping fashion. This approach only provides a small percentage of size reduction.

SUMMARY OF THE INVENTION

According to one aspect of the invention there is provided a multifilar helix antenna comprising a plurality of helical antenna filaments spaced apart from each other at regular intervals about a longitudinal axis of the antenna, each said helical antenna filament having a meander along its length.

Preferably, the meander is periodic and may have a rectangular waveform shape.

In a preferred embodiment the multifilar helix antenna is a printed multifilar helix antenna. Said periodic meander preferably has a square waveform pattern.

As mobile communications systems evolve there is now an urgent need for mobile communications antennas capable of operating over multiple relatively wide frequency bands and yet are compact and light weight.

One known dual band QHA comprises two tuned helix antennas, one inside another or a monopole antenna (which may be wound) placed inside a helix antenna and tuned to a higher frequency, and yet another known dual band helix antenna comprises a helix antenna and a separate parasitic element. Another known dual band QHA comprises a single helix antenna having an increasing or a decreasing pitch angle, and in yet another arrangement PIN diodes are provided to short circuit segments of the helical antenna filaments creating an antenna having two different resonant frequencies. These known antennas have complex structures and are difficult and expensive to manufacture in practice.

According to another aspect of the invention there is provided a multifilar helix antenna comprising a plurality of helical antenna filaments spaced apart from each other at regular intervals about a longitudinal axis of the antenna and wherein each said helical antenna filament incorporates a band stop filter for enabling multi-band operation.

The band stop filter is preferably a microstrip spur-line band stop filter.

Said one and another aspects of the invention may be implemented in combination.

BRIEF DESCRIPTION OF DRAWING FIGURES

Figure 1B:
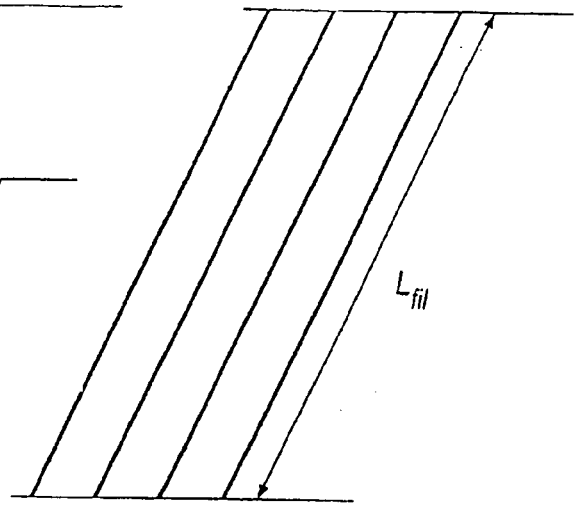
Figure 2A:
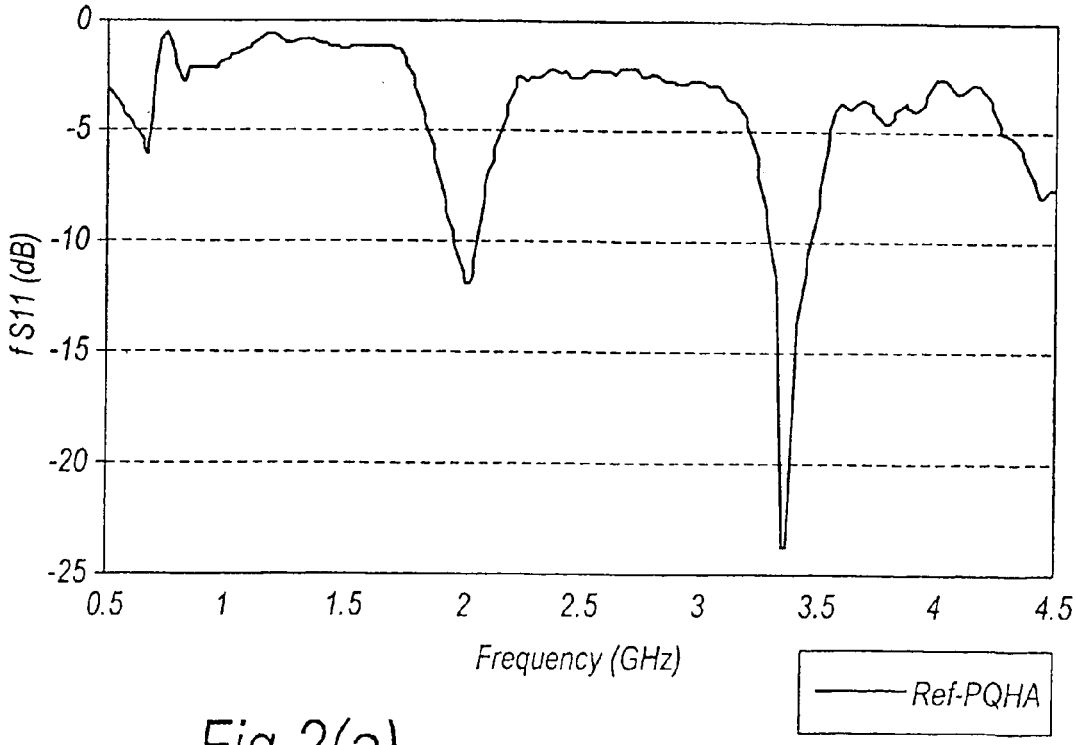
Figure 2B:
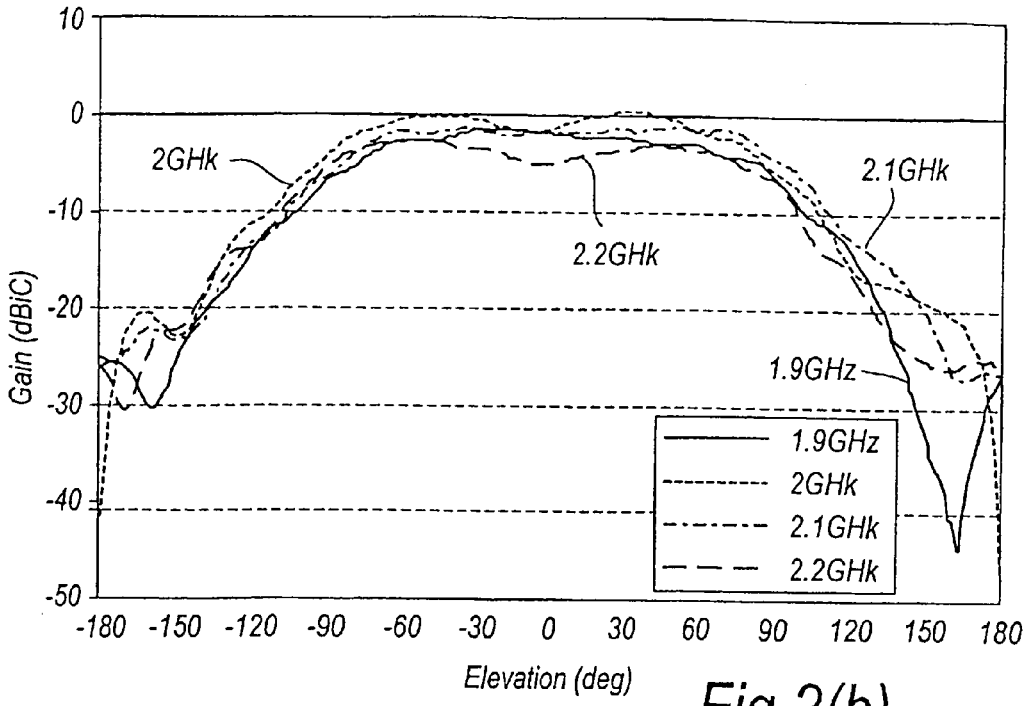
Figure 3:
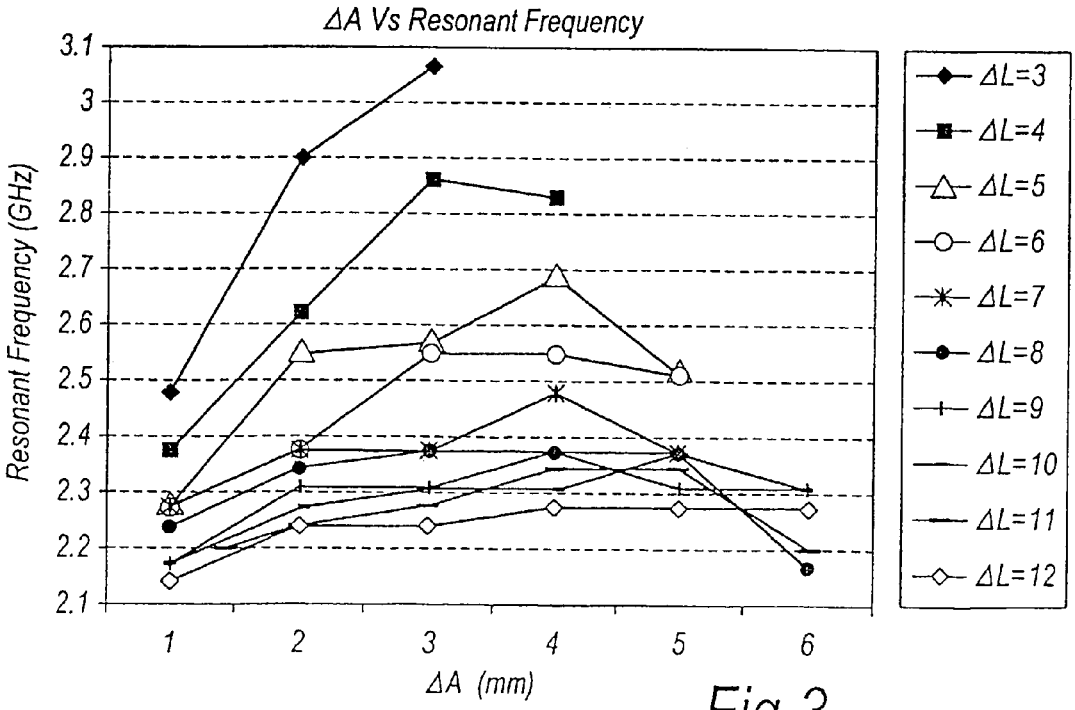
Figure 4A:
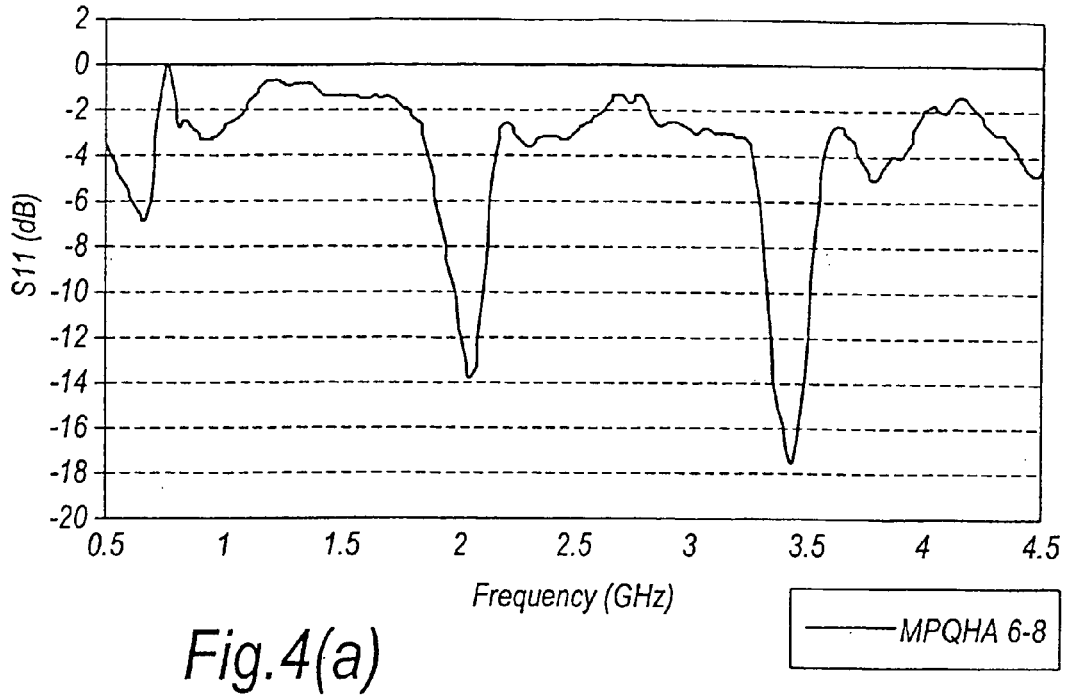
Figure 4B:
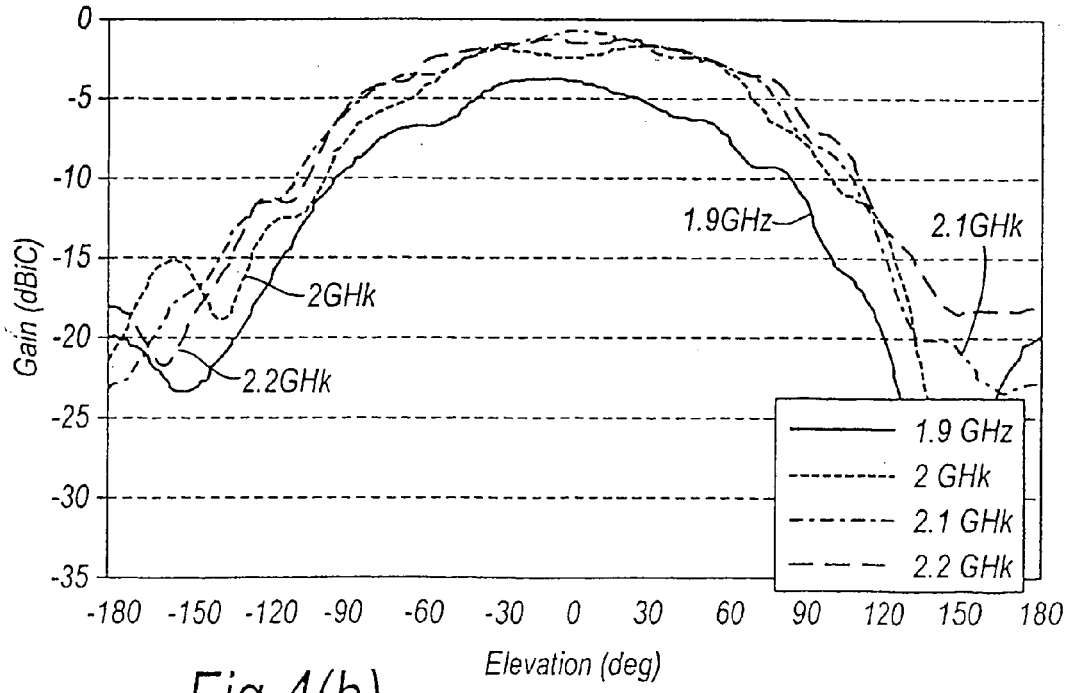
Figure 4C:
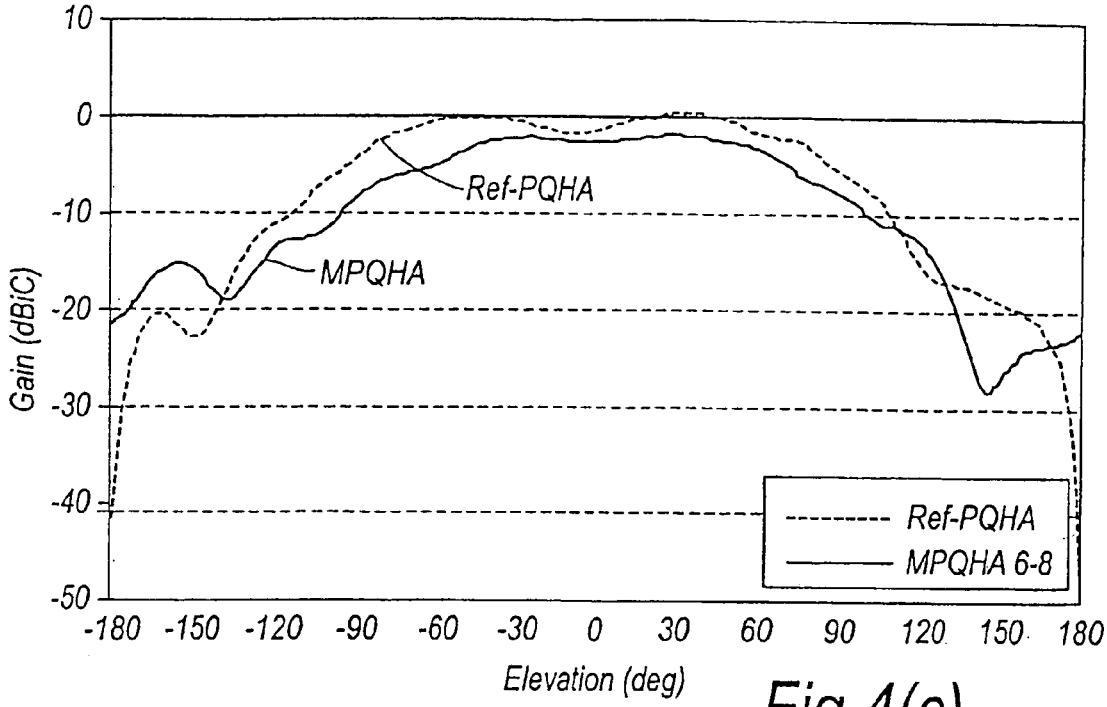
Figure 5A:
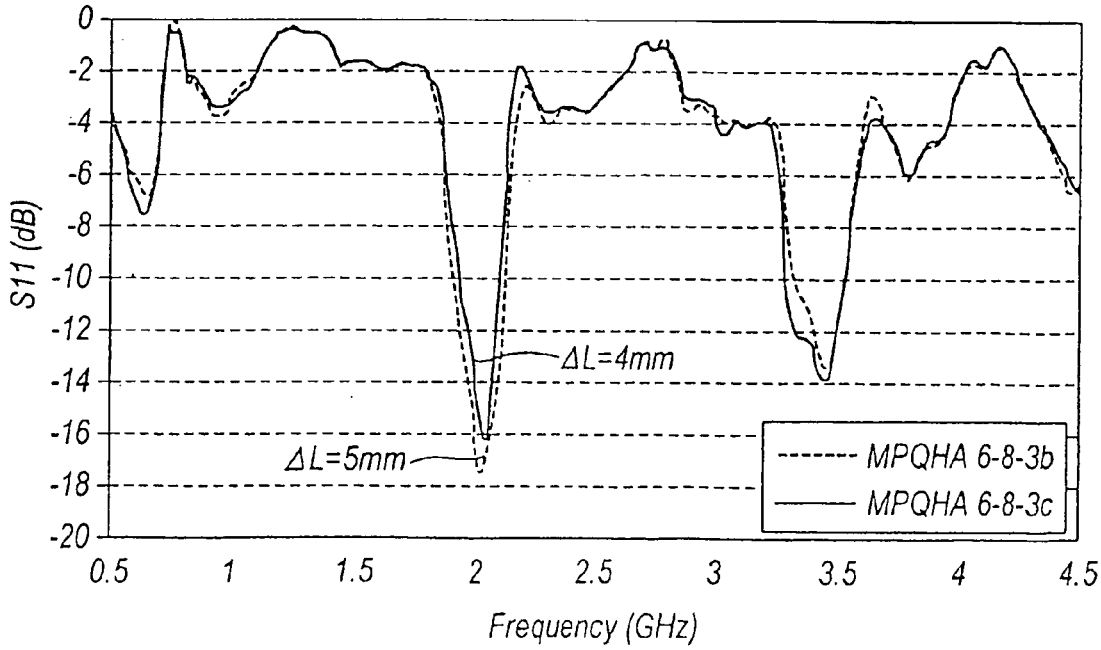
Figure 5B:
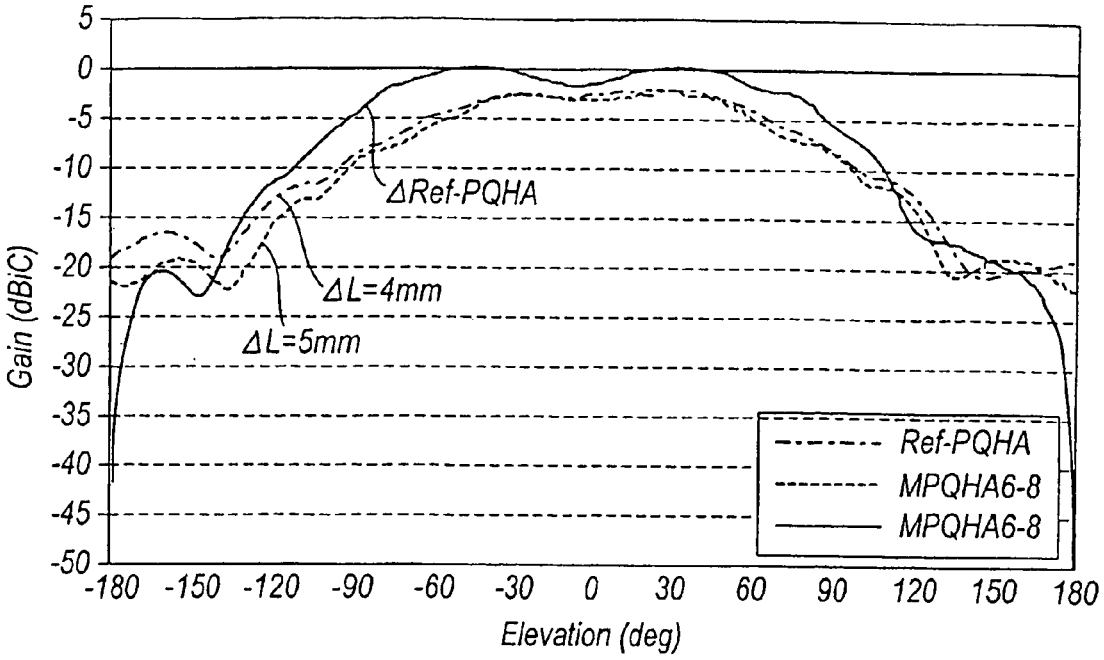
Figure 6:
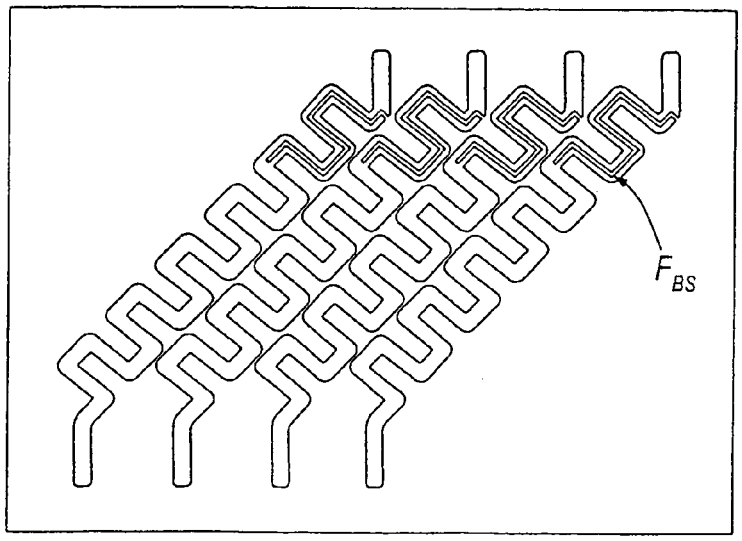
Figure 7:
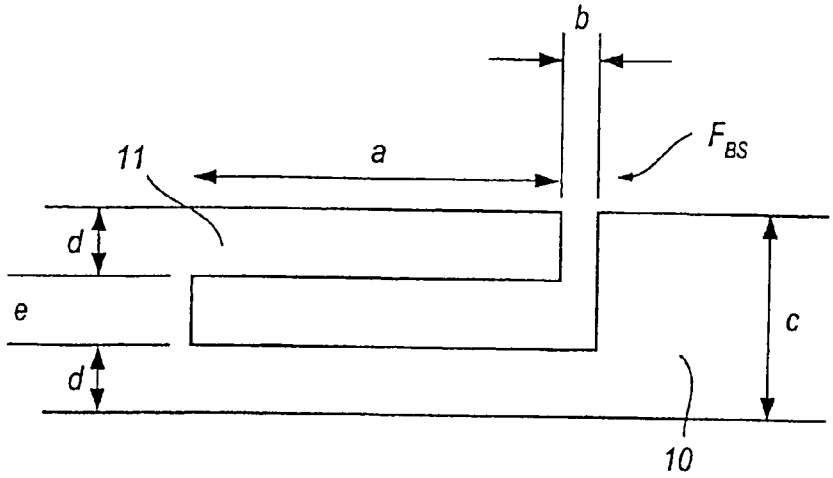
Figure 8A:
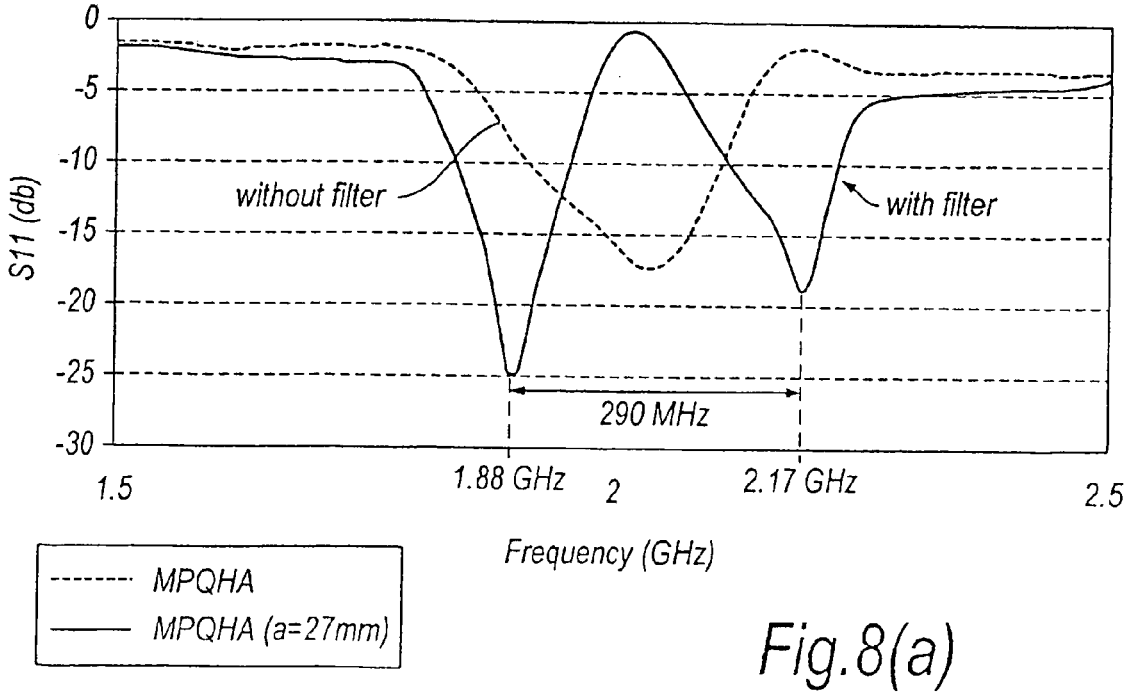
Figure 8B:
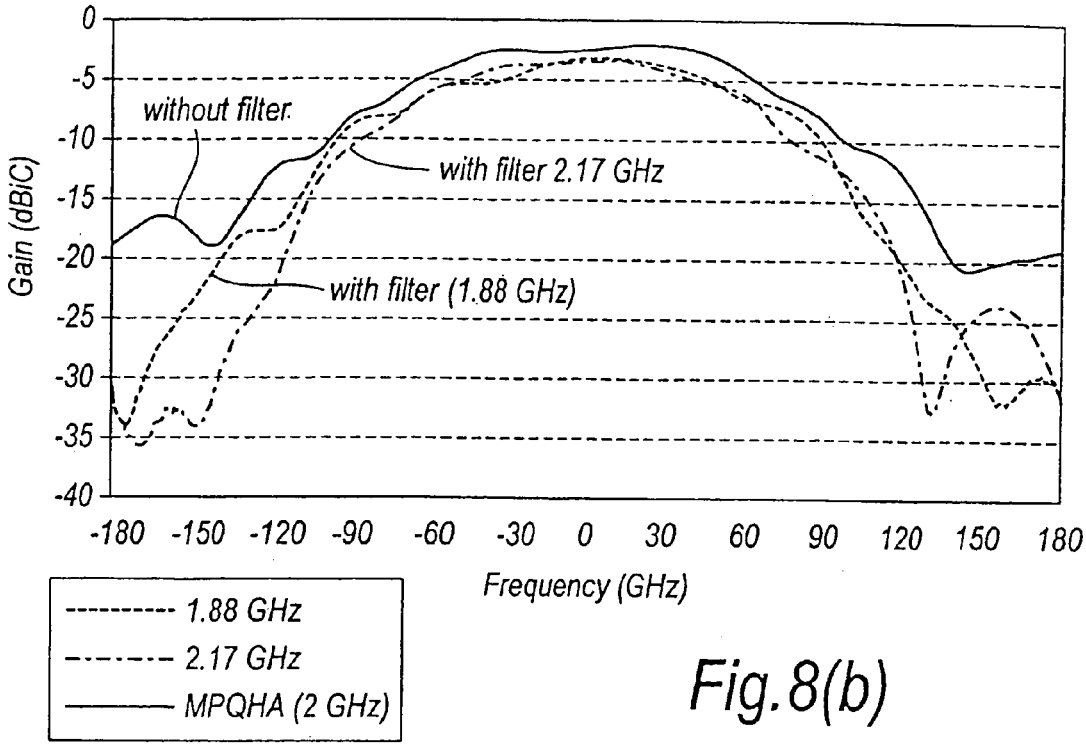
Figure 9:
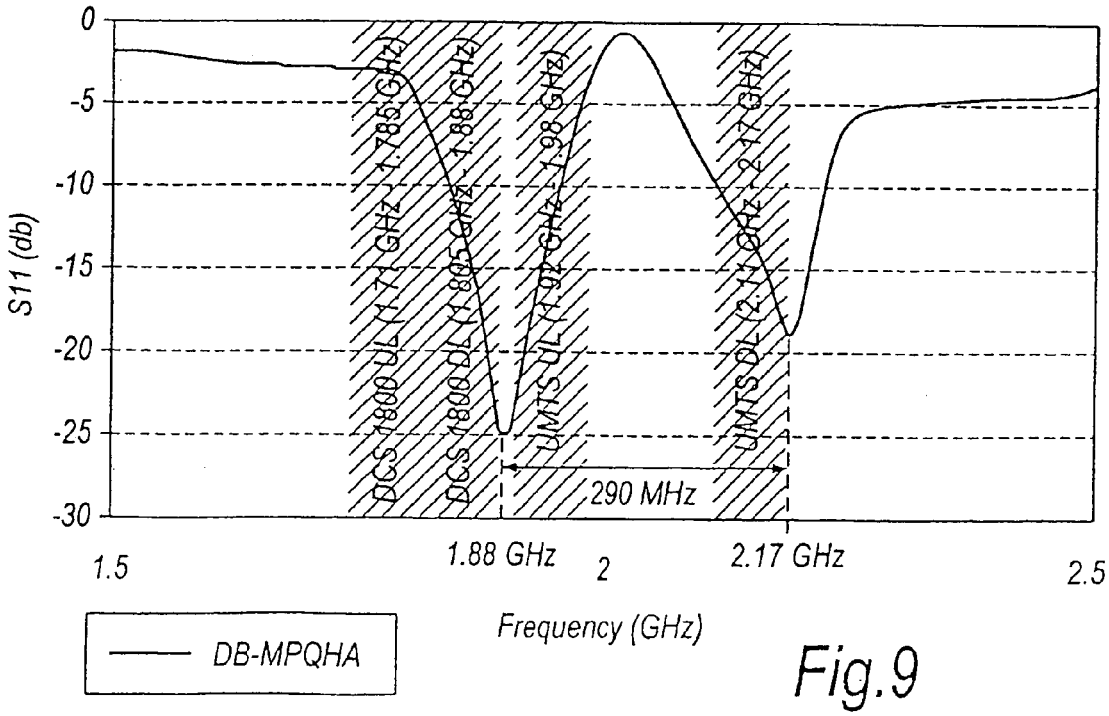
Figure 10:
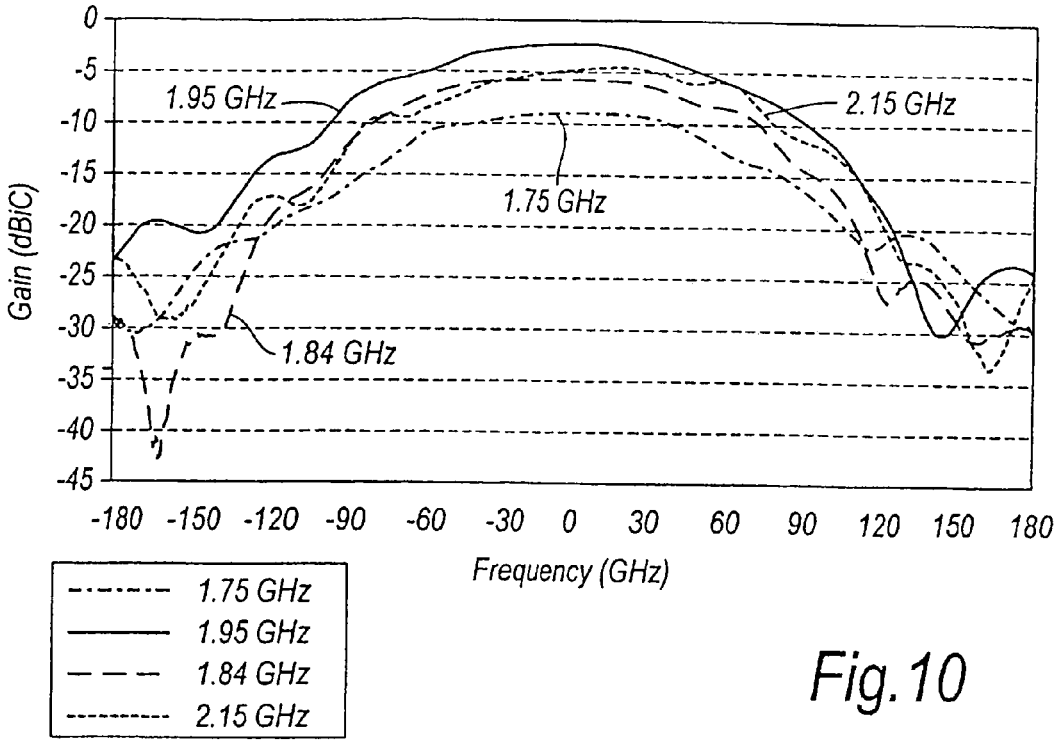
Figure 11:
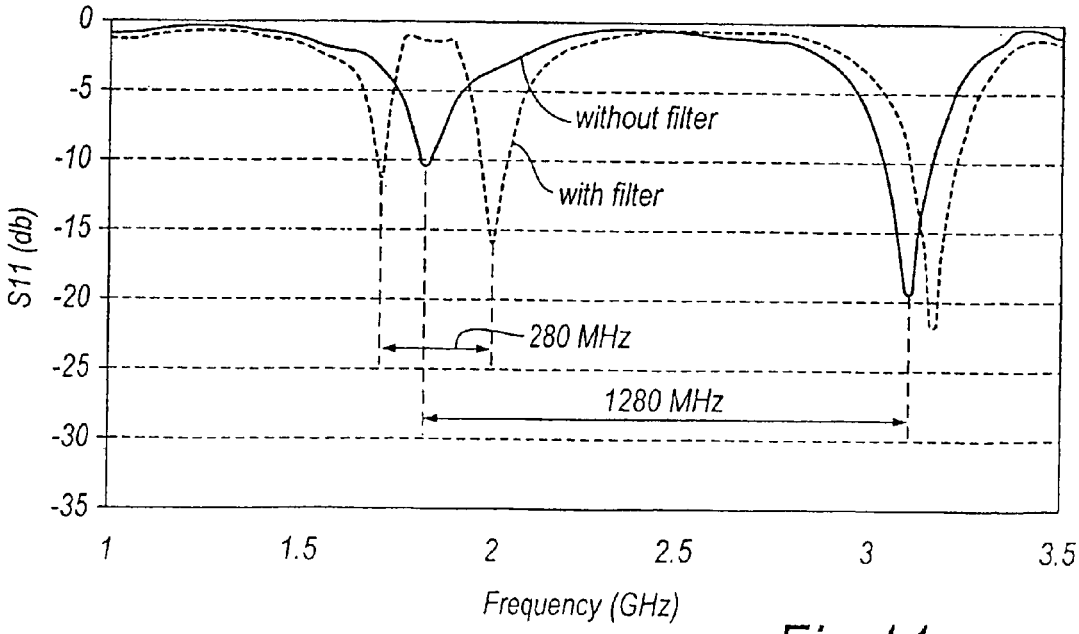

Embodiments of the invention are now described, by way of example only, with reference to the accompanying drawings in which:

FIG. 1(*a*) shows a planar representation of the helical filaments of a MPQHA according to one aspect of the invention, FIG. 1(*b*) shows a planar representation of a conventional PQHA, FIG. 2(*a*) shows a plot of antenna return loss as a function of frequency obtained for a reference PQHA, FIG. 2(*b*) shows the radiation pattern obtained for the reference PQHA at four different frequencies, FIG. 3 shows plots of frequency F as a function of ΔA obtained for different implementations of MPQHA, FIG. 4(*a*) shows a plot of antenna return loss as a function of frequency obtained for an optimised MPQHA, FIG. 4(*b*) shows the radiation pattern obtained for the optimised MPQHA at four different frequencies, FIG. 4(*c*) shows radiation patterns obtained for the optimised MPQHA and for the reference PQHA at 2 GHz, FIG. 5(*a*) shows plots of antenna return loss as a function of frequency obtained using optimised values of ΔL, FIG. 5(*b*) shows radiation patterns obtained using the optimised values of ΔL and for the reference PQHA, at 2 GHz, FIG. 6 shows a planar representation of the helical filaments of a MPQHA according to a further aspect of the invention, FIG. 7 is a schematic view of a section of filament track containing a band stop filter, FIG. 8(*a*) is a plot of antenna gain as a function of frequency obtained for a MPQHA with and without a microstrip spur-line band stop filter, FIG. 8(*b*) shows radiation patterns for a DB MPQHA according to said further aspect of the invention, FIG. 9 shows the respective positions of the DSC 1800 and UMTS frequency ranges in the plot of FIG. 8(*a*), FIG. 10 shows radiation patterns obtained for the DB MPQHA at four different frequencies, FIG. 11 shows plots of antenna return loss as a function of frequency for a PQHA according to the further aspect of the invention.

DETAILED DESCRIPTION

The inventors have discovered that the axial length of a multifilar helix antenna can be significantly reduced, without substantial loss of performance, if each filament of the antenna is provided with a periodic meander along its length.

Preferably, the meander has a rectangular waveform pattern, and preferred embodiments of the invention will now be described, by way of example, with reference to a meander printed quadrifilar helix antenna in which each filament has a square waveform pattern; that is, a rectangular waveform pattern having a mark-to-space ratio of unity. These embodiments will be referred to hereinafter as MPQHA.

FIG. 1(*a*) of the drawings shows a planar representation of the MPQHA and FIG. 1(*b*) shows a planar representation of a corresponding conventional printed quadrifilar helix antenna (PHQA).

In practice, each filament of the MPQHA consists of a track formed by printing on an outer surface of a cylindrical substrate. The tracks follow helical paths, and are spaced apart from each other at regular intervals about the longitudinal axis of the substrate.

Each periodic element 10 of the meandered filaments has a length 2ΔL and a width W=ΔA+w, where ΔA is the height of the square waveform pattern and w is the width of the track, and so the total length of each filament is 2n (ΔL+ΔA), where n is the number of elements in the filament.

As described in "Antenna Design for the ICO Handheld Terminal" by Agius A. A. et al, 10th International Conference on Antennas and Propagation, 14–17 Apr. 1997, Conference Publication, No. 436, IEE 1997, the total length $L_{fil}$ of each filament of a conventional PQHA can be related to the axial length Laxial by the expression:

$$L_{fil} = N\sqrt{\left(\frac{Laxial}{N}\right)^2 + (2\pi r)^2}$$

where r is the radius of the PQHA.

In analgous fashion, it can be shown that the axial length Laxial (MPQHA). of the MPQHA can be expressed as:

$$Laxial(MPQHA) = N\sqrt{\left(\frac{2n\Delta L}{N}\right)^2 - (2\pi r)^2} \quad \text{for} \left(\frac{2n\Delta L}{N}\right)^2 > (2\pi r)^2$$

As shown in FIGS. 1(*a*) and 1(*b*), for comparable filaments, having the same total length, the axial length of the MPQHA is significantly less than the axial length of the conventional PQHA, and the size reduction factor α can be defined as:

$$\alpha = \frac{Laxial(PQHA) - Laxial(MPQHA) \times 100\%}{Laxial(PQHA)}$$

The values selected for ΔL and ΔA will affect both the physical size and the frequency response characteristic of the antenna. However, the geometry of a quadrifilar helix antenna does impose certain constraints on the range of values that can be used in practice. In particular, neighbouring filments must not touch or overlap each other, and this imposes an upper limit on the value of ΔA. This upper limit, $\Delta A_{max}$ can be expressed as:

$$\Delta A_{\max} = \left(\frac{2\pi r}{4}\sin\phi\right) - w$$

where ϕ is the pitch angle of the MPQHA.

Also, the value of ΔL has a lower limit $\Delta L_{min}$ given by:

$$\Delta L_{min} = w+1$$

where $\Delta L_{min}$ and w are both expresed in millimetres.

In order to assess the physical and operational characteristics of the MPQHA, the axial length and resonant frequency of each of a wide range of different implementations of the MPQHA was compared with the axial length and resonant frequency of a reference PQHA. The PQHA chosen for this purpose had the following geometric parameters:

| | |
|---|---|
| Axial length, Laxial (PQHA) | 83 mm |
| Total Filament Length, $L_{fil}$ | 89.315 mm |
| Antenna radius, r | 7 mm |
| Track width w | 2 mm |
| Number of Turns, N | 0.75 |
| Resonant Frequency, F | 2 GHz |

Each implementation of the MPQHA used in the comparison had the same values of $L_{fil}$ (89.315 mm), r (7 mm), w (2 mm) and N (0.75).

Table 1 below shows the axial length (in millimetres) of the MPQHA for each of a number of different combinations of ΔA (selected from the range of values 1–6 mm) and of ΔL (selected from the range of values 3 to 12 mm).

TABLE 1

| | ΔA (mm) | | | | | |
|---|---|---|---|---|---|---|
| ΔL (mm) | 1 | 2 | 3 | 4 | 5 | 6 |
| 3 | 58.301 | 42.233 | 30.102 | | | |
| 4 | 63.382 | 49.571 | 38.944 | 30.102 | | |
| 5 | 66.72 | 54.606 | 45.033 | 37.067 | 30.102 | |
| 6 | 69.084 | 58.301 | 49.571 | 42.233 | 35.835 | |
| 7 | 70.847 | 61.135 | 53.11 | 46.285 | 40.328 | |
| 8 | 72.213 | 63.382 | 55.957 | 49.571 | 43.964 | 38.944 |
| 9 | 73.303 | 65.207 | 58.301 | 52.299 | 46.995 | 42.233 |
| 10 | 74.193 | 66.72 | 60.267 | 54.606 | 49.571 | 45.033 |
| 11 | 74.932 | 67.995 | 61.94 | 56.584 | 51.791 | 47.453 |
| 12 | 75.558 | 69.084 | 63.382 | 58.301 | 53.727 | 49.571 |

As can be seen from this Table the MPQHAs have axial lengths which are all less than that of the reference PQHA, regardless of the combination of values ΔA, ΔL chosen.

FIG. 2(*a*) shows a plot of antenna return loss a function of frequency f obtained for the reference PQHA using an HP8510A network analyser (NWA). This plot shows that the first resonance frequency occurs at 2 GHz with a bandwidth of about 90 MHz, which is particularly desirable for mobile communications applications. The input impedance $Z_{in}$ at 2 GHz was calculated to be 61.7037-j 27.0820Ω. FIG. 2(*b*) shows the radition pattern obtained from the reference PQHA at 2 GHz.

FIG. 3 shows plots of resonant frequency F as a function of ΔA obtained for the MPQHA for the different combinations of ΔA, ΔL presented in Table 1. This Figure shows that whereas the different MPQHA implementations all have axial lengths that are less than that of the reference PQHA, their resonant frequencies are all higher than 2 GHz obtained for the reference PQHA, and are typically in the range 2.3 GHz to 2.4 GHz. The range of resonant frequencies obtained for the different MPQHA implementations is relatively small, even though their axial lengths span a relatively wide range. This is because the capacitance/unit length and the inductance/unit length both vary as a function of ΔA and ΔL.

It was found that the MPQHA implementations investigated had generally lower resonant frequencies for larger values of ΔA (typically larger than 2 mm) than the resonant frequencies obtained using an equivalent conventional meander line dipole (MDA). These lower frequencies at larger values of ΔA are attributable to mutual coupling between opposite filament elements of the antenna which does not, of course, occur in a MDA. Therefore, the MDQHA can offer a significant advantage over a MDA.

The results provided in Table 1 are grouped according to axial length and a meander geometric parameter β, where $$\beta = \frac{\Delta A}{\Delta L}.$$

The different groupings are presented in Table 2 along with the resonant frequency for each combination of ΔA,ΔL represented in the Table as "MPQHA a-1", where a is the value of ΔA and 1 is the value of ΔL. Also, included in each grouping is the resonant frequency of a PQHA having the same axial length.

TABLE 2

| Group 1 Axial Length = 30.102 mm and β = 1 | | | | |
|---|---|---|---|---|
| Name | PQHA | MPQHA 3-3 | MPQHA 4-4 | MPQHA 5-5 |
| Freq. (GHz) | 3.525 | 3.07 | 2.83 | 2.51725 |

| Group 2 Axial Length = 38.944 mm and β = 0.75 | | | |
|---|---|---|---|
| Name | PQHA | MPQHA3-4 | MPQHA6-8 |
| Freq. (GHz) | 3.1775 | 2.86475 | 2.17 |

| Group 3 Axial Length = 42.233 mm and β = 0.667 | | | | |
|---|---|---|---|---|
| Name | PQHA | MPQHA2-3 | MPQHA4-6 | MPQHA6-9 |
| Freq. (GHz) | 3.07325 | 2.8995 | 2.552 | 2.30875 |

| Group 4 Axial Length = 45.033 mm and β = 0.3 | | | |
|---|---|---|---|
| Name | PQHA | MPQHA3-5 | MPQHA6-10 |
| Freq. (GHz) | 2.93425 | 2.57 | 2.30875 |

| Group 5 Axial Length = 49.571 mm and β = 0.5 | | | | | | |
|---|---|---|---|---|---|---|
| Name | PQHA | MPQHA 2-4 | MPQHA 3-6 | MPQHA 4-8 | MPQHA 5-10 | MPQHA 6-12 |
| Freq. (GHz) | 2.79525 | 2.6215 | 2.552 | 2.37825 | 2.37825 | 2.274 |

| Group 6 Axial Length = 54.606 mm and β = 0.4 | | | |
|---|---|---|---|
| Name | PQHA | MPQHA2-5 | MPQHA4-10 |
| Freq. (GHz) | 2.58675 | 2.552 | 2.30875 |

| Group 7 Axial Length = 58.301 mm and β = 0.333 | | | | | |
|---|---|---|---|---|---|
| Name | PQHA | MPQHA 1-3 | MPQHA 2-6 | MPQHA 3-9 | MPQHA 4-12 |
| Freq. (GHz) | 2.552 | 2.48 | 2.37825 | 2.30875 | 2.2742 |

| Group 8 Axial Length = 63.382 mm and β = 0.25 | | | | |
|---|---|---|---|---|
| Name | PQHA | MPQHA1-4 | MPQHA2-8 | MPQHA3-12 |
| Freq. (GHz) | 2.37825 | 2.37825 | 2.3435 | 2.23925 |

| Group 9 Axial Length = 66.720 mm and β = 0.2 | | | |
|---|---|---|---|
| Name | PQHA | MPQHA1-5 | MPQHA2-10 |
| Freq. (GHz) | 2.274 | 2.274 | 2.274 |

| Group 10 Axial Length = 69.084 mm and β = 0.167 | | | |
|---|---|---|---|
| Name | PQHA | MPQHA1-6 | MPQHA2-12 |
| Freq. (GHz) | 2.274 | 2.274 | 2.23925 |

These tabulations clearly demonstrate that the majority of MPQHA implementations (i.e. those having β values greater than about 0.25), resonate at frequencies that are lower than the resonant frequency of a PQHA having the same axial length. Also, it will be seen that axial length of the MPQHA decreases as the value of β increases.

None of the MPQHA implementations listed in Table 2 resonantes at 2 GHz, required for some mobile communications applications. Therefore, for such applications, the design parameters need to optimised to provide a MPQHA which resonates at or very close to 2 GHz and yet has an axial length much smaller than that of the reference PQHA.

The MPQHA implementation in Group 2 of Table 2 having the value ΔA=6 mm and the value ΔL=8 mm was chosen for optimisation because the axial length (38.944 mm) and resonant frequency (2.17 GHz) are both relatively small.

Three different optimisation methods were considered.

The first optimisation method consists of increasing only the total length $L_{fil}$ of each filament by from 5% to 15%. Table 3 shows how increases by 5%, 10% and 15% effect the resonant frequency and axial length of the MPQHA.

TABLE 3

| Name | MPQHA 6-8 | MPQHA 6-8 | MPQHA 6-8 | MPQHA 6-8 |
|---|---|---|---|---|
| Percentage increase (%) | 0 | 5 | 10 | 15 |
| Element length (mm) | 89.315 | 93.78075 | 98.2465 | 102.71225 |
| Axial length (mm) | 38.944 | 42.233 | 45.428 | 48.546 |
| Freq. (GHz) | 2.17 | 2.17 | 2.18 | 2.04 |

An increase of $L_{fil}$ by 15% has the effect of reducing the resonant frequency of the antenna to 2.05 GHz, but at the expense of axial length which increases to 48.546 mm. The operating bandwidth of the optimised MPQHA is 130 MHz.

FIG. 4(*a*) shows a plot of antenna return loss as a function of frequency obtained using the optimised MPQHA, FIG. 4(*b*) shows the radiation pattern obtained from the optimised MPQHA at four different frequencies and FIG. 4(*c*) shows radiation patterns obtained from the optimised MPQHA and from the reference PQHA at 2 GHz.

From FIG. 4(*b*) it can be seen that the optimised MPQHA also radiates with greater efficiency at frequencies higher than 2 GHz, and it can be seen from FIG. 4(*c*) that the optimised MPQHA radiates with slightly less efficiency than the reference PQHA, but, of course, has a much reduced axial length, the size reduction factor α being 41.5%.

The second optimisation method consists of varying the value of ΔA while the value of ΔL is kept constant. As already explained, the value of ΔA has an upper limit $\Delta A_{max}$. It was found that no significant reduction of resonant frequency could be achieved by this method within the constraints imposed by the antenna geometry.

The third optimisation method consists of varying the value of ΔL while ΔA is kept constant. This method has the advantage that the axial length of the antenna can be kept constant (at 38.944 mm), even though the value of ΔL is varied.

Table 4 shows the resonant frequency obtained for different values of ΔL in the range 3 mm to 10 mm.

TABLE 4

| Name | MPQHA 6-8 | MPQHA 6-8 | MPQHA 6-8 | MPQHA 6-8 | MPQHA 6-8 | MPQHA 6-8 | MPQHA 6-8 |
|---|---|---|---|---|---|---|---|
| ΔA (mm) | 6 | 6 | 6 | 6 | 6 | 6 | 6 |
| ΔL (mm) | 3 | 4 | 5 | 6 | 7 | 9 | 10 |
| β | 2 | 1.5 | 1.2 | 1 | 0.857 | 0.667 | 0.6 |
| Element length (mm) | 147 | 124 | 110 | 96 | 91 | 81 | 81 |
| Axial length (mm) | 38.944 | 38.944 | 38.944 | 38.944 | 38.944 | 38.944 | 38.944 |
| Freq. (GHz) | 1.90 | 2.03 | 2.06 | 2.13 | 2.16 | 2.29 | 2.28 |

Clearly, the optimum values of ΔL are 4 mm (giving a resonant frequency of 2.03 GHz) and 5 mm giving a resonant frequency of (2.06 GHz). The operating bandwidth for both of these implementations is 190 MHz.

FIG. 5(*a*) shows plots of antenna return loss as a function of frequency obtained for these two values of ΔL, and FIG. 5(*b*) shows radiation patterns obtained for the two values of ΔL and for the reference PQHA, all at 2 GHz.

As can be seen from FIG. 5(*b*) both optimised MPQHAs radiate less efficiently than the reference PQHA. Also, by comparing FIGS. 5(*b*) and 4(*b*) it can be seen that the optimised MPQHA's obtained using the third optimisation method radiate less efficiently than the optimised MPQHA obtained using the first optimisation method. However, the third optimisation method gives a size reduction factor α of 53% which is much higher than that obtained using the first optimisation method.

The inventors have also found that there is some advantage in reducing the track width w. If the track width w is reduced, the radius r of the MPQHA can also be reduced without neighbouring filaments overlapping. Also, a reduced track width w enables the value of ΔA to be reduced giving a higher value β and a further reduction in axial length.

The resonant frequencies given in Table 4 above were all measured using MPQHAs having a track width of 2 mm. The inventors have found that by reducing the track width to 1 mm there is no significant change of resonant frequency, at least for the MPQHAs having the values ΔL 3 mm, 4 mm and 5 mm. However, in each case the operating bandwidth is narrower.

It will be apparent from the foregoing that it is possible to optimise one or more geometric parameters of the MPQHA to give a significant reduction in axial length as compared with a reference PQHA and a desired resonant frequency.

It will be appreciated that the invention is not restricted to the square waveform meander pattern; other periodic meander patterns can be used, including rectangular waveform patterns having mark-to-space ratios greater or less than unity.

The MPQHAs that have been described are all designed to operate within a single frequency band (centred on 2 GHz, for example). However, for some applications an antenna having a multi-band operation is needed.

An example of this is an antenna for a dual band mobile communications system which is intended to operate in accordance with both the DCS 1800 and the UMTS standards. The frequency ranges required for this application are as follows:

| | |
|---|---|
| DCS 1800 (Uplink) | 1710 MHz to 1785 MHz |
| DCS 1800 (Downlink) | 1805 MHz to 1880 MHz |
| UMTS (Uplink) | 1920 MHz to 1980 MHz |
| UMTS (Downlink) | 2100 MHz to 2170 MHz |

In a further embodiment of the invention, a microstrip spur-line band stop filter is incorporated in each filament of a MPQHA at one end. As will be explained, the effect of the band stop filter is to create the required dual band operation.

FIG. 6 shows a planar representation of the MPQHA filaments, each incorporating a microstrip spur-line band stop filter $F_{BS}$. FIG. 7 is a schematic view of a section of filament track 10 containing the band stop filter, and for clarity of illustration the square-waveform meander pattern has been omitted from this Figure.

Referring to FIG. 7, the microstrip spur-line band stop filter $F_{BS}$ consists of a coupled pair of microstrip lines connected together at one end and open circuit at another end. As described in "Design of microstrip spur-line band stop filters", Bates, R. N. IEEE Microwaves, Optics and Acoustics, Vol 1, No. 6, pp 209–214, the centre frequency $f_o$ of the band stop filter is related to the length a of the spur line 11 and to the gap b between the spur line 11 and the track 10 by the expression $$a = \frac{2.997925 \times 10^8}{f_o\sqrt{K_{effo}}} - b$$

where a and b are expressed in metres, $f_o$ is expressed in Hz and $K_{effo}$ is the odd mode effective dielectric constant.

In this embodiment, the MPQHA has the optimum geometric parameters as determined by the previously described third optimisation method i.e.

| | |
|---|---|
| ΔA | 6 mm |
| ΔL | 4 mm |
| N | 0.75 |
| r | 7 mm |
| $L_{fil}$ | 124 mm |
| Axial length | 38.944 |
| Resonant Freq (F) | 2.03 GHz |

In order to accomplish the required dual band operation the following band stop filter parameters were used

| | |
|---|---|
| a | 27 mm |
| b | 0.5 mm |
| c | 2 mm |
| d | 0.75 mm |
| e | 0.5 mm |

FIG. 8*a* shows a plot of antenna return loss as a function of frequency obtained for the MPQHA with and without the microstrip spur-line band stop filter.

As can be seen from this Figure, the effect of the bandstop filter is to eliminate the resonant frequency at 2.03 GHz and to create two new resonant frequencies at 1.88 GHz and 2.17 GHz, giving rise to a lower frequency band and an upper frequency band respectively. The lower frequency band has an operating bandwidth of 110 MHz (extending from 1.84 GHz to 1.95 GHz) and the upper frequency band has an operating bandwidth of 100 MHz (extending from 2.12 GHz to 2.22 GHz). Thus, the effect of the bandstop filter is to create a dual band MPQHA referred to hereinafter as DB-MPQHA.

FIG. 8*b* shows the radiation patterns for the DB-MPQHA at each resonant frequency (i.e. at 1.88 GHz and 2.17 GHz) and this Figure also shows the radiation pattern for the MPQHA (without the bandstop filter) at the resonant frequency 2 GHz.

The gain difference between the MPQHA and the DB-MPQHA at 1.88 GHz at elevation angle 0° is only 0.6 dB and the gain difference between the MPQHA and the DB-MPQHA at 2.17 GHz at elevation angle 0° is slightly higher at 1.1 dB.

FIG. 9 shows the positions of the afore-mentioned DCS 1800 and UMTS frequency ranges superimposed on the plot of antenna return loss for the DB-MPQHA presented in FIG. 8*a*. This demonstrates that the dual band antenna operates in the lower frequency band for DCS 1800 and for the uplink of UMTS and operates in the upper frequency band for the downlink of UMTS.

FIG. 10 shows radiation patterns obtained for the DB-MPQHA at four different frequencies. This Figure shows that the DB-MPQHA radiates more efficiently in the frequency ranges required for UMTS than in the frequency ranges required for DCS 1800. However, the radiation patterns are substantially the same at all frequencies which suggests that the reduction in efficiency at lower frequencies is due to poor matching, and it is believed that this problem can be resolved using an adaptive matching technique as described in PCT Publication No. WO99/41803.

It will be understood that although the microstrip spur-line band stop filter has been described with reference to a meander printed quadrifilar helix antenna, this is not the only application of the band stop filter. Alternatively, a microstrip spur-line band stop filter could be applied to an otherwise conventional printed quadrifilar helix antenna (PQHA) to provide a required dual band operation.

Thus, in a further embodiment, a microstrip spur-line band stop filter was incorporated in each filament of a PQHA having the following geometric parameters:

| | |
|---|---|
| Axial length | 96 mm |
| $L_{fil}$ | 102 mm |
| r | 7 mm |
| Track width | 2 mm |
| N | 0.75 |
| Resonant Freq (F) | 1.8 GHz |

The values of the band stop filter parameters were the same as those used for the MPQHA described earlier, except for the value of the parameter a. In fact, three different values of a were investigated (a=15 mm, 21 mm, 31 mm); however, only the value a=31 mm had a significant effect. FIG. 11 shows plots of antenna return loss as a function of frequency for the $S_{11}$ mode for the PQHA with and without the microstrip spur-line band stop filter. As can be seen from this Figure the effect of the band stop filter when a=31 mm is to eliminate the resonant frequency at 1.8 GHz and create new resonant frequencies at 1.70 GHz and 1.98 GHz giving rise to upper and lower frequency bands, respectively.

Although the foregoing embodiments have all been described with reference to quadrifilar helix antennas, it will be understood that the invention is also applicable to multifilar helix antennas having more than four helical antenna filaments.

It will be appreciated that any of the described multifilar helix antennas may be used in, and is particularly well suited to, an adaptive multifilar antenna arrangement as described in International Publication Nos. WO 99/41803 and WO 01/18908.

The invention claimed is:

1. A multifilar helix antenna comprising:

a cylindrical substrate; and a plurality of helical antenna filaments spaced apart from each other at a regular interval about a longitudinal axis of the antenna, wherein each of said helical antenna filaments has a length, each of said helical antenna filaments comprises a track located on the cylindrical substrate, and each of said helical antenna filaments has a periodic meander along its length, the periodic meander having a square wavelength pattern of periodic elements, each periodic element having a length $2\Delta L$, the square wavelength pattern having a height $\Delta A=W-w$, where W is width of each periodic element and w is width of the track of said filament, and $\beta=\Delta A/\Delta L$ and is at least 0.25.

2. The multifilar helix antenna as claimed in claim 1, wherein the track is formed by printing.

3. The multifilar helix antenna as claimed in claim 1, wherein $\beta$ is in the range from 0.25 to 1.0.

4. The multifilar helix antenna as claimed in claim 1, wherein said multifilar helix antenna is a quadrifilar helix antenna.

5. The multifilar helix antenna as claimed in claim 1, wherein each of said helical antenna filaments incorporate a band stop filter for multi-band operation.

6. the multifilar helix antenna as claimed in claim 5, wherein each of said band stop filters is a microstrip spur-line band stop filter.

7. The multifilar helix antenna as claimed in claim 5, wherein each of said helical antenna elements comprise a printed track and each of said band stop filters is a microstrip spur-line band stop filter located in the track of a respective helical antenna filament.

8. The multifilar helix antenna as claimed in claim 5, wherein said band stop filters enable dual band operation.

9. The multifilar helix antenna as claimed in claim 8, wherein the dual band operation is suitable for the DCS 1800 and UMTS standards.

10. A mobile communications terminal including a multifilar helix antenna as claimed in claim 1.

11. A multifilar helix antenna comprising a plurality of helical antenna filaments spaced apart from each other at a regular interval about a longitudinal axis of the antenna, wherein each of said helical antenna filaments incorporates a microstrip spur-line band stop filter enabling multi-band operation.

12. The multifilar helix antenna as claimed in claim 11, wherein each of said helical antenna filaments comprises a printed track and each of said microstrip spur-line band stop filters is located in the track of a respective helical antenna filament.

13. The multifilar helix antenna as claimed in claim 11, wherein said band stop filters enable dual band operation.

14. The multifilar helix antenna as claimed in claim 13, wherein the dual band operation is suitable for the DCS 1800 and UMTS standards.

15. The multifilar helix antenna as claimed in claim 11, wherein said multifilar helix antenna is a quadrifilar helix antenna.

* * * * *